US005106097A

United States Patent [19]

Levine

[11] Patent Number: 5,106,097

[45] Date of Patent: Apr. 21, 1992

[54] AUDIO QUIZ GAME

[75] Inventor: Barry Levine, New York, N.Y.

[73] Assignee: Rykodisc, Philadelphia, Pa.

[21] Appl. No.: 662,232

[22] Filed: Feb. 28, 1991

Related U.S. Application Data

[63] Continuation-in-part of Ser. No. 217,886, Feb. 12, 1988, abandoned.

[51] Int. Cl.[5] ..... A63F 9/18; G09B 7/00

[52] U.S. Cl. ..... 273/237; 273/431; 273/460; 434/319; 434/321

[58] Field of Search ..... 273/237, 430, 431, 460, 273/DIG. 28; 434/315, 321, 319, 348

[56] References Cited

U.S. PATENT DOCUMENTS

| | | | |
|---|---|---|---|
| 3,145,481 | 8/1964 | Aldershof | 434/348 |
| 3,971,141 | 7/1976 | Wilson | 434/319 X |
| 4,273,337 | 6/1981 | Carrera et al. | 273/DIG. 26 X |
| 4,326,711 | 4/1982 | Giallombardo | 273/341 |
| 4,336,935 | 6/1982 | Goldfarb | 273/460 |
| 4,372,554 | 2/1983 | Orenstein | 273/237 X |
| 4,490,810 | 12/1984 | Hon | 273/DIG. 28 X |
| 4,593,904 | 6/1986 | Graves | 273/460 X |
| 4,677,604 | 6/1987 | Selby III et al. | 434/315 X |
| 4,749,354 | 6/1988 | Kerman | 434/321 |

*Primary Examiner*—William H. Grieb

*Attorney, Agent, or Firm*—Wolf, Greenfield & Sacks

[57] ABSTRACT

An apparatus and method of playing an audio quiz game wherein a player attempts to answer a question after listening to a corresponding audio clip provided on a compact disc. Each track of the compact disc contains one or more sound clips separated by audio cues. The questions and answers relating to specific tracks are provided in a book, or playing cards, or in computer memory, and can be randomly accessed.

21 Claims, 8 Drawing Sheets

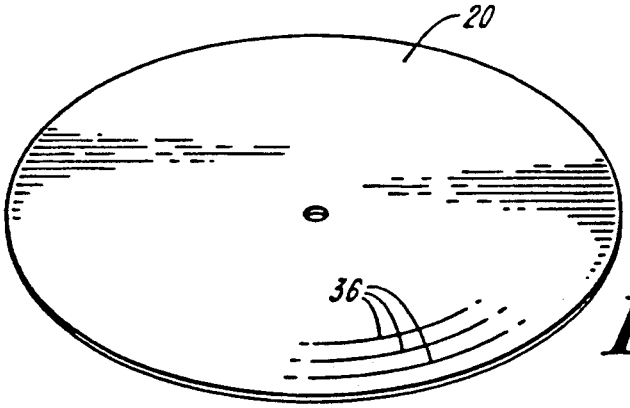
FIG. 1
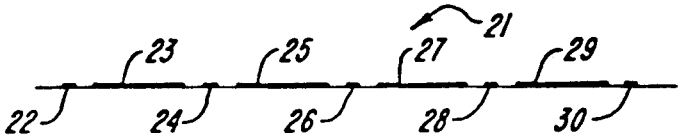
FIG. 2
FIG. 3
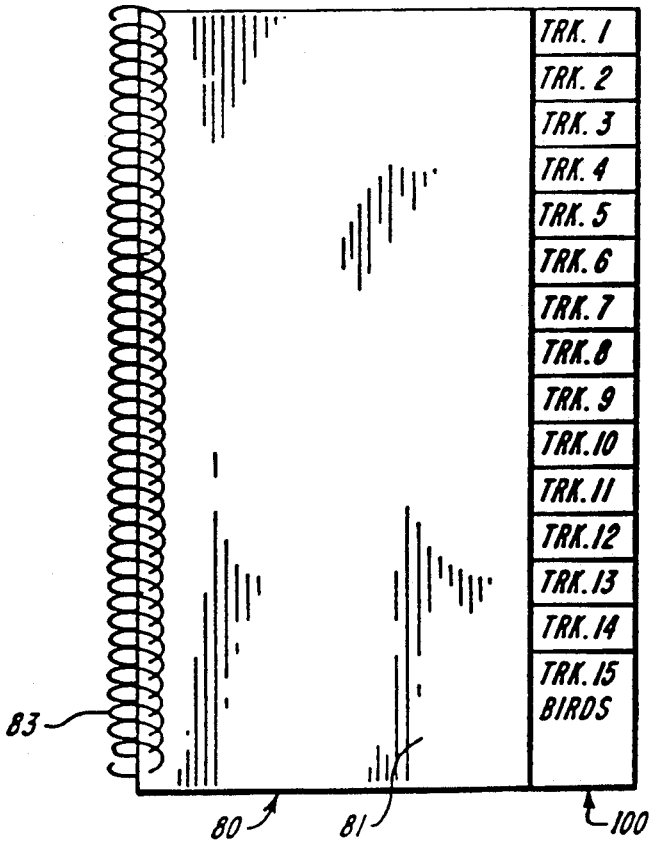

AUDIO QUIZ GAME

This is a continuation-in-part application of U.S. Ser. No. 07/217,886, filed July 12, 1988, now abandoned.

BACKGROUND OF THE INVENTION

This invention relates to an audio quiz game, and more specifically to a game which provides a series of questions which correspond to different audio clips contained on a compact disc.

One of the most popular games on the market today is the game "Trivial Pursuit." In that game the players move their playing pieces around a board and try to collect six different colored pie-shaped segments by correctly answering questions in six different subject matter areas. The questions and answers are provided on a plurality of cards, with six questions, one from each of the subject matter areas, and their answers, on each card. When a player lands on an appropriate board space by roll of the die, a card from the top of the deck is taken and the random board location determines the subject matter of the question to be answered from that card. Thus, the different instructions on the different board spaces and the randomness by which cards are drawn from the stack, generate the random manner in which the questions are asked. In order to keep the game "fresh," a number of different card stacks may be purchased with questions directed to different subject matters which are of interest to different target audiences. However, a basic limitation of the game is that the subject matter of the given question must be presented as a printed question on a card.

It would be desirable to provide a quiz game wherein the questions correspond to information presented in a non-print format.

SUMMARY OF THE INVENTION

It is an object of the present invention to provide an apparatus and method of playing a quiz game wherein the players interact with audio clips.

Another object is to provide such a game which provides a series of written questions which correspond to audio clips.

Yet another object is to provide such a game where the questions and related audio clips may be randomly accessed and played.

A further object is to provide such a game wherein the series of questions and corresponding audio clips are broken down into specific subject areas.

A still further object is to provide such a game wherein questions with different levels of difficulty may be provided for each audio clip.

Another object is to provide a source of written questions and answers wherein the answer to a single question may be displayed without gaining access to any other answers.

The invention concerns an audio quiz game wherein a player provides an answer to a preselected question after listening to a preselected audio clip. The game includes a digital storage device, such as a compact disc, having a plurality of tracks for storing digital information. The tracks contain different audio clips disposed at predetermined locations and separated by audio cues, wherein each track may be selectively accessed and the clips played in conjunction with a preselected question.

The game also includes a source of questions and answers which relate to the audio clip. In one embodiment, a book of written questions and answers is provided which includes means for identifying the number of the audio clip to which a given question and answer relates, and means for selectively accessing the answer to one question at a time. In this embodiment, the game further includes means for randomly selecting the next clip to be played, which may constitute a spinner or a random shuffle feature of a compact disc player. A game board is provided with spaces on which playing pieces are advanced. The questions may be classified by number as to the degree of difficulty and a correct answer enables the player to advance the designated number of spaces on the playing board equal to the number degree of difficulty. Other features include a matrix form for keeping track of questions previously asked in a game so that no question is repeated. Wild cards may introduce an additional element of chance into the game. Additional features of more advanced CD players may also be utilized to further enhance the speed or diversity of the game. Still further, the game may be provided with an additional visual aspect by also providing display information on the compact disc for viewing on a video display screen. As a further alternative the questions, answers, and game board may be provided in computer memory.

In a second preferred embodiment, instead of a book, the questions, answers and related track numbers are printed on playing cards. The cards are held in a card holder which allows selective access to the cards. Shuffling of the cards insures random access to specific tracks. A plurality of different card decks are provided, one deck being used for each match, in order to keep the playing "fresh." In addition, challenges or bets can be placed on whether a team will correctly answer a question which adds a further element of chance and increases the amount of points awarded for a correct answer. These and other aspects of the game are more fully described hereinafter.

BRIEF DESCRIPTION OF THE DRAWINGS

FIG. 1 is a top perspective view of a compact disc to be used in the game of this invention.

FIG. 2 is a schematic representation of one track from the compact disc.

FIG. 3 is a top plan view of a book containing written questions and answers to be used in a first embodiment of this invention.

DETAILED DESCRIPTION OF THE PREFERRED EMBODIMENTS

Figure 4:
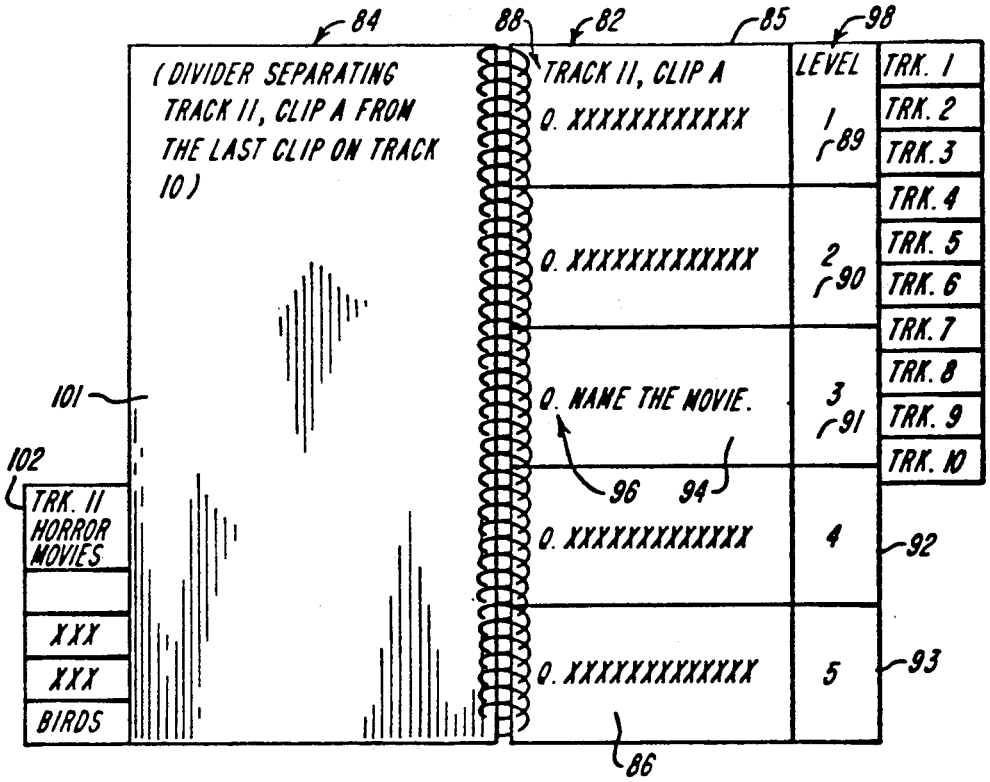
FIG. 4 is a top plan view of a selected page corresponding to track 11, clip A, in the book of FIG. 3.

In the audio quiz game of this invention players are asked questions about short audio clips randomly accessed and played on a compact disc player. The game is played by one or more players (or multiple player teams) who randomly access the questions provided by a source of questions and answers.

The game includes an optical disc, such as compact disc 20, on which digital information is stored in a plurality of tracks 36, shown schematically in FIG. 1. For example, compact discs having 99 tracks and compact disc players (see FIG. 11) for selectively accessing and playing all tracks of such discs are widely available on the market.

In the game of this invention, the compact disc 20 contains a series of short audio clips specially arranged on the tracks to permit random and immediate access thereto. In a preferred embodiment, each track 36 has three or four brief audio clips, ranging from one second to several minutes per clip. Thus, there are about 100 to 400 short clips on the disc. At the end of every clip, and at the end and beginning of every track, there is an audio tone or cue which, as described hereinafter, signifies that the user should pause. Also, at the beginning of every clip there may be a narrated voice which reads an identifying clip letter number. e.g., "A" (then the clip). tone; "B" (then the clip). tone: and so on. Furthermore at the end of each track the narrated voice states "end of track no. _," before the last tone. Still further, all of the clips on a given track may relate to one subject matter, such that there are 99 subject matters on 99 different tracks. Each track may be identified by a number or other track-identifying means. In alternative embodiments, there may be one, two, or five or more audio clips per track, and the tracks may be divided into track sets of, for example, 24–25 tracks per set, with each set of tracks associated with a different game number. Two specific embodiments of the game are described below, although variations thereof will be readily apparent which may be considered as falling within the scope of this invention.

DETAILED DESCRIPTION OF FIRST EMBODIMENT

As shown schematically in FIG. 2, in a first embodiment track 21 on disc 20 consists of four sequentially arranged audio clips 23, 25, 27, 29, identified as clips A, B, C, and D, that are separated by audio cues 22, 24, 26, 28, 30. The narrated identification of the clip letter is included at the beginning of each of the respective clips 23, 25, 27, 29 and the narrated "end of track no. _" identification is included at the end of clip 29.

The subject areas for the various audio clips may include, for example, cartoons and comic strips, classic flicks, horror movies, comedians, speeches, animals, pop music, tongue twisters, short-term memory, news and history, sports, TV, and radio programs.

The compact disc 20 is played on compact disc player 50 (FIG. 11) which includes a front control panel 51 with a slot 65 for inserting and removing disc 20 via open/close button 66. Panel 51 includes a "track skip forward" button 53 and a "track skip reverse" button 52 for skipping sequentially forward and backward between tracks. A "search" button 56 is used in combination with a numeric keyboard 67 for skipping directly to the track having the number entered on the keyboard. A "play/pause" button 54 and a "stop" button 55 are used for selectively playing, pausing and stopping. A "track no./index no." display 63 is provided which indicates the track number or, when used, the index number. The other buttons 58–60 are used for playing alternative embodiments of the game as described hereinafter. The player 50 contains a laser beam head assembly for reading the information on tracks 36 of disc 20 and the player is connected to amplifier 70 and speakers 71 for converting this information into audible form.

Figure 5:
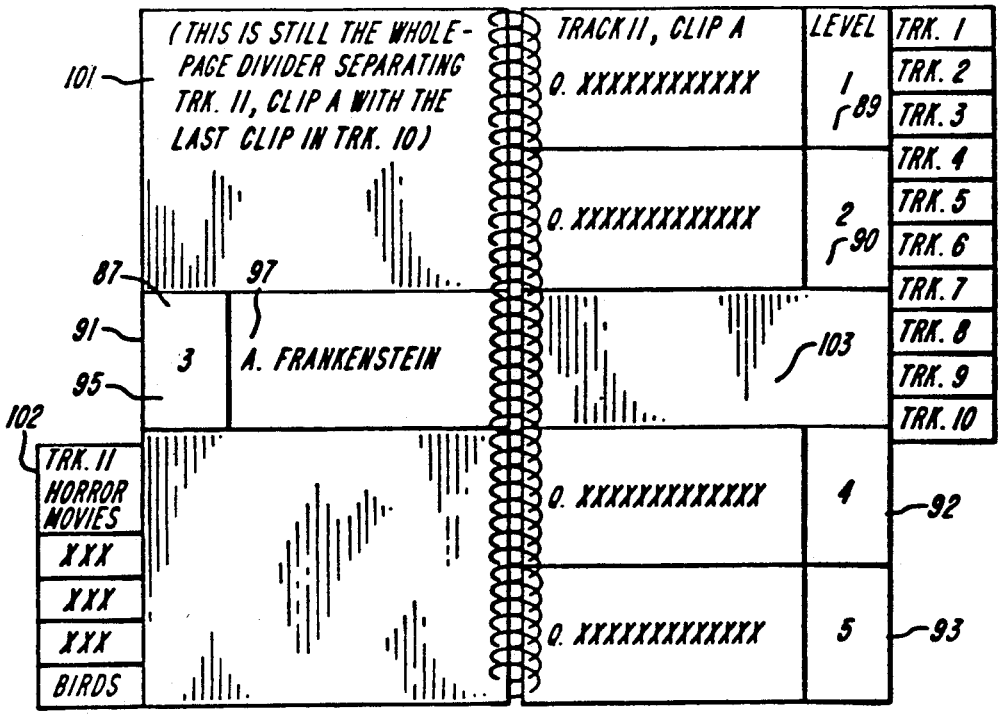
FIG. 5 is a top plan view of the page of FIG. 4, but wherein segment 3 of the page has been turned over.

As shown in FIGS. 3–5, a book 80 is provided containing written questions and the correct answers. The book includes a front cover sheet 81, a plurality of rectangular sheets of equal size constituting pages 82, and a plurality of rectangular sheet dividers 84 before and after each page which are of the same size as the pages 82, but which have tabs 100 extending outwardly from the right margin (as viewed from the front). The pages 82 and dividers 84 are bound at their left-hand margin by metal spiral binding 83 which enables each of the pages and dividers to be turned separately in the book.

The tabs 100 provided on the right margin of the dividers (left margins as seen from the rear) each identify one of the 99 tracks on the compact disc 20 and the subject matter of that track. The tabs facilitate quick access to selected pages in the book, adjacent to the specific tab, which pages bear the questions relating to the track identified on the tab. For example, as shown in Fig. 4, by selecting the tab 102 for track 11 the user gains immediate access to the questions and answers for track 11 which immediately follow the divider 101 with tab 102. Four pages, one for each of clips A, B, C, D, of track 11, are provided directly behind tab 102 in the letter order designated, with a divider between each page.

One page 82 is provided for each clip on disc 20 and contains five questions concerning that clip. Furthermore, each of the questions are provided on separate segments of the page. For example, as shown in FIG. 4, page 85 has five vertically-spaced segments 89, 90, 91, 92, 93, each containing a separate question identified by a level number as shown in column 98. All of the questions relate to track 11, clip A, as designated by the heading 88 on the top segment 89. The question appears on the front side of the segment and the corresponding answer on the back side of the segment. Thus, for example, segment 91 has question 96 on its front surface 94 and answer 97 on its back surface 95. The random accessibility to any question, and limited accessibility to a single answer as provided by book 80, will be further described hereinafter with regard to operation of the game.

Figure 6:
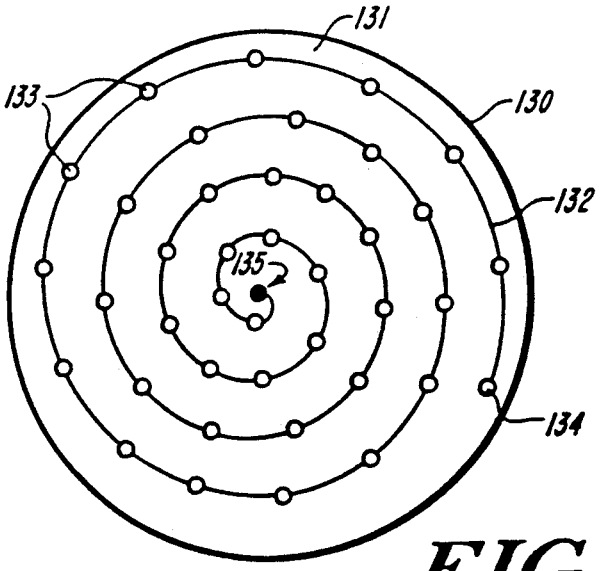
FIG. 6 is a top plan view of the game board used in a first embodiment.
Figure 9:
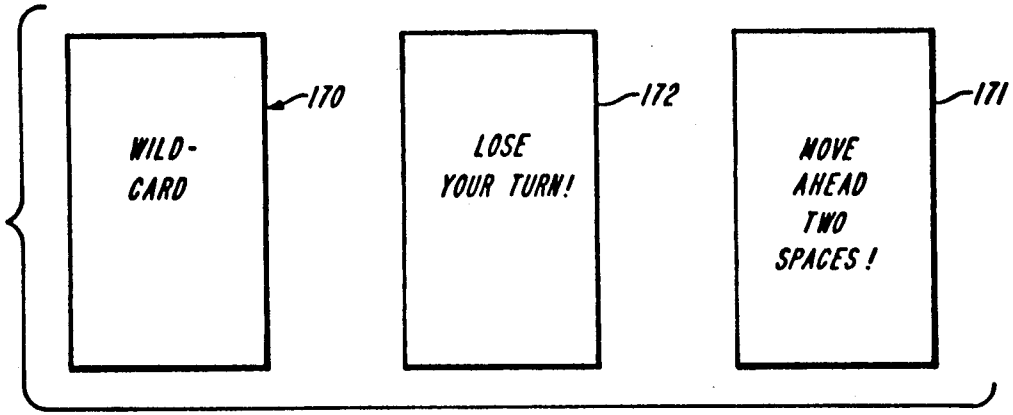
FIG. 9 is a top plan view of the wild cards used in the first embodiment.
Figure 10:
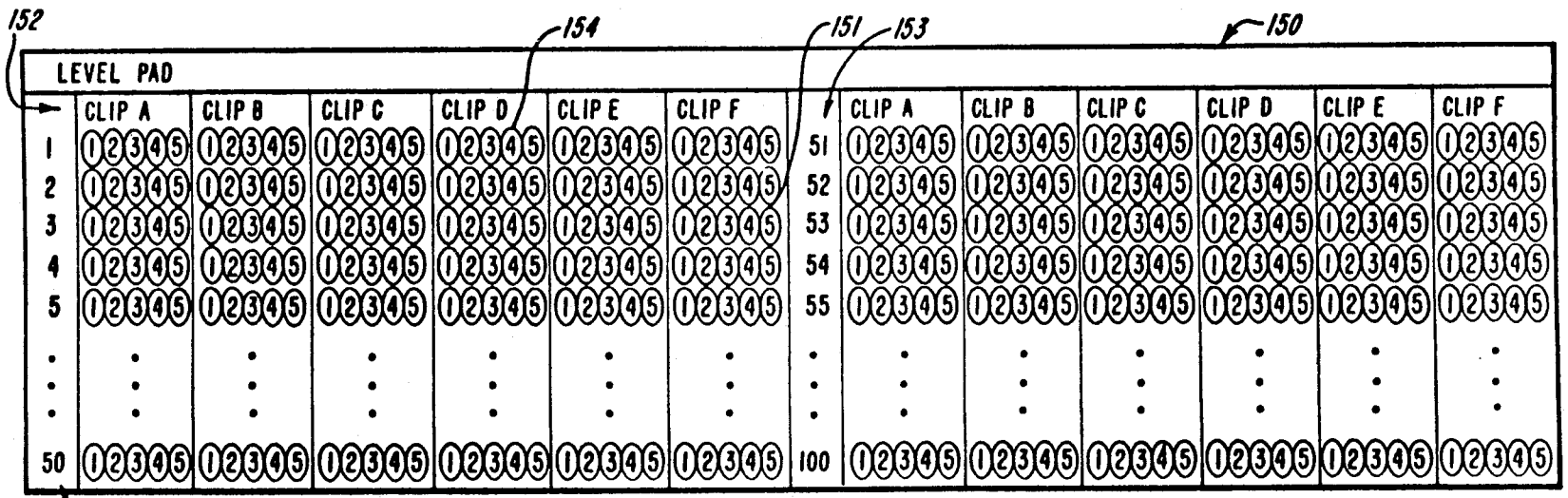
FIG. 10 is a top plan view of the level pad for keeping a record of the questions previously asked, as used in the first embodiment.

The other components of the game include: game board 130 (FIG. 6), playing pieces or tokens 140 (FIG. 7), spinner 120 (FIG. 8), wild cards 170 (FIG. 9), and level pad 150 (FIG. 10). These components will be described more fully hereinafter in regard to operation of the game.

Operation of the game by teams A and B, for example, will now be described.

Figure 7:
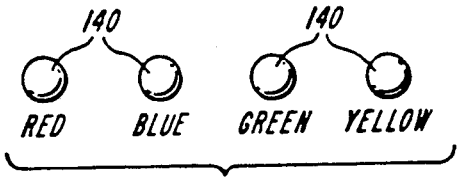
FIG. 7 is a top plan view of the playing pieces used in the first embodiment.

Each team selects one of the red, blue, green or yellow playing pieces 140 (FIG. 7). The object of the game is to advance your team's playing piece 140 around the sequential spaces 133 of spiral track 132, on the top surface 131 of game board 130, from the starting space 134 to the finishing space 135, by correctly answering a series of questions relating to the audio clips on the compact disc.

Figure 8:
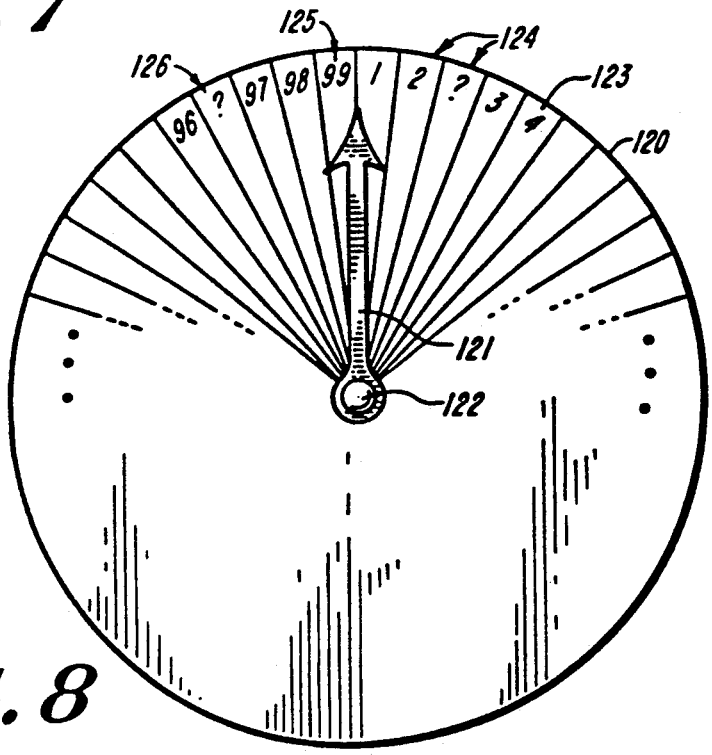
FIG. 8 is a top plan view of the spinner used in the first embodiment.

Assume team A has the first turn. Team A spins the needle 121 which rotates about pin 122 of spinner 120 (FIG. 8). The needle will stop on one of the pie-shaped segments 124 marked on the top surface 123 of spinner 120. Each segment bears one number 125 from the set of numbers 1-99, or a question mark (?) 126. Each of the numbers 125 corresponds to one of the 99 track numbers on compact disc 20. The question marks 126 correspond to wild cards 170 shown in FIG. 9, and described hereinafter.

For example, if team A spins to the segment bearing the number "11" on spinner 120, any one player who has been designated the "CD jockey" inserts compact disc 20 into slot 65 of compact disc player 50 (FIG. 11) and advances the player head to track no. 11 by pushing down the "track skip forward" button 53. Alternatively, if the CD player has a searching feature as shown schematically in FIG. 11 by "search" button 56, track no. 11 can be searched for directly (as opposed to sequentially), by entering the track number in a numeric keyboard provided with the CD player. Track no. 11 will appear in the "track no./index no." display screen 63 on the front panel 51 of CD player 50.

A member of team B now turns to the section of book 80 relating to track 11, which follows the divider 101 with tab 102, labeled "track 11, Horror Movies." Thus, all of the four clips on track 11 relate to horror movies. The first page following the divider is page 85 identified by heading 88, and bearing the five questions for track 11, clip A. There are five levels of questions for clip A as designated in the level column 98. Level 1 is the easiest, and level 5 is the hardest. If the question is answered correctly, the number of spaces moved by the player equals the question level (e.g., level 1 if answered correctly entitles the player to move one space). Suppose level 3 was chosen by team A. The question for level 3 is asked by team B: "Name the movie." The CD jockey then pushes the play/pause button 54 and plays clip A of track 11 on the CD player. At the beginning of clip A a narrated voice identifies the clip as "A." A short audio segment from a horror movie is then played and when the audio cue at the end of clip A is heard, the CD jockey again hits the play/pause button 54 to pause the player 50 at the end of clip A. Team A then attempts to answer the question "Name the movie" as it relates to the audio clip just heard. The correct answer is provided (to team B only) by turning over segment 91 in the book to reveal the answer on the back surface: "A. Frankenstein." Because each of the segments on page 85 are separate, team B gains access only to the answer to the level 3 question, and not access to the answers to the questions for levels 1, 2, 4 and 5. If team A has correctly answered the question, team A advances its playing piece 140 three spaces on the game board 130. The question played is recorded on the level pad 150 as described hereinafter so that a question is only played once in each game. Team A then continues onto the next clip, clip B of track 11, and as long as team A continues to provide the correct answer, it progresses serially through each of the clips of track 11. If all of the clips in the track are answered correctly, team A spins again for another track. Team A continues until it does not answer a question correctly. Because the clips within one track can be serially accessed by simply pushing the "play/pause" button 54, and because the questions for all clips of a given track are serially arranged in book 80, the speed of play is increased.

When a team spins to a question mark (?) segment on spinner 120, it selects one of wild cards 170 provided in a stack of such cards. It then follows the direction on the back side of the wild card. Good luck wild cards are provided, such as card 171 bearing the directions "Move ahead two spaces!" Bad luck cards are also provided, such as card 172 bearing the directions "Lose your turn!"

Level pad 150, shown in FIG. 10, is provided for making a record of the questions previously played in a game so that no question is asked twice in one game. Thus, after each attempt to answer a question, one player marks off with a pencil or pen a space in pad 150 relating to that question. Pad 150 includes a left-hand column designation 153 for each of tracks 1-99 and an upper row designation 152 for each of clips A-F. The rows and the columns provide a rectangular matrix and within each matrix position there are five ovals corresponding to the five levels for each clip of a given track. Thus, following team A's first turn, the oval marked "3" in column 11, clip A is checked off.

Alternative versions of the game may be obtained by utilizing additional features of higher-priced compact disc players, such as indexing, random shuffle, and programability. For example, the use of one or more program buttons 58 (shown schematically in FIG. 11) may be used to selectively play a predetermined sequence of tracks. The track sequence may be programmed ahead of the game to speed up the pace of the game and would eliminate the need for spinner 120. As a second example, a random shuffle feature provided by one or more buttons 59 (shown schematically in FIG. 11) creates a random sequence of tracks to be played. This would also eliminate the need for spinner 120. As a third example, an indexing feature provided by one or more buttons 60 (shown schematically in FIG. 11) enables specific clips within a given track to be accessed immediately. With this feature each clip is given an absolute address, or index number, and by use of a numeric keyboard a specific index no. (clip) can be immediately accessed. This also allows clip repeatability, for example, if a player wishes to hear a given audio clip repeated before providing an answer.

Figure 12:
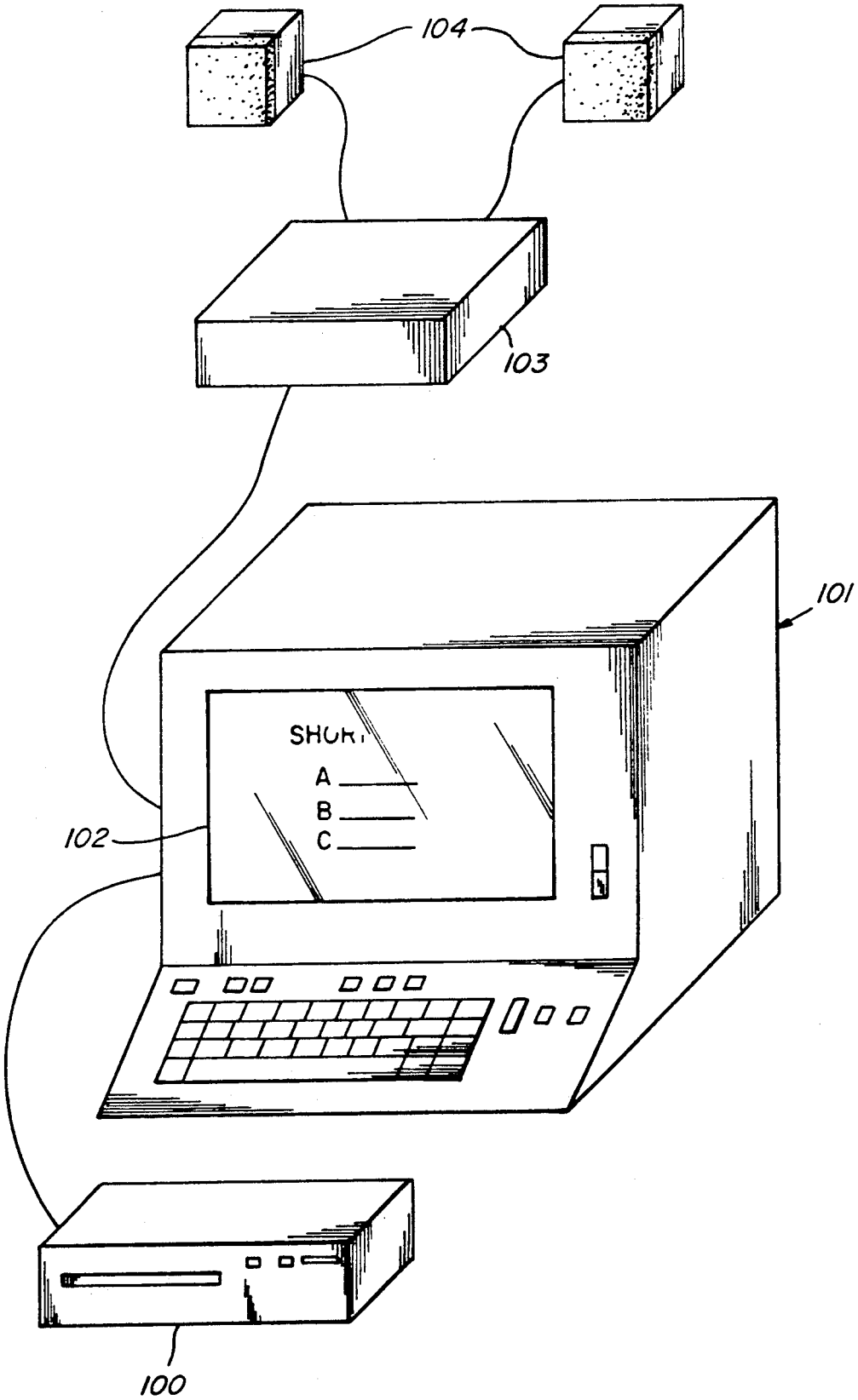
FIG. 12 is a front perspective view of a computer terminal for use in an alternative version of the game.

As a still further alternative, the game may incorporate a video display along with the audio clips (see e.g., FIG. 12). Thus, the information stored on the compact disc might include video as well as audio information and by hooking the CD player up to a video display screen, both the audio and video information may he played simultaneously. For example, both video and audio portions of a horror movie may be provided on a specific clip.

A still further alternative is to provide the questions and answers and the game board on a display screen and store the same in computer memory. Thus, for example as shown in FIG. 12, a CD ROM drive 100 may be attached to a MacIntosh personal computer 101 wherein the drive accepts audio compact discs. Alternatively, the drive 100 may be integral with the computer terminal 101. The written questions and answers and game board may be stored in the computer 101 and displayed on the computer screen 102 while the audio clips on the disc are read by the computer and sent to an amplifier 103 and speakers 104 for audio display.

Yet another alternative is to store the audio clips on digital audio tape (DAT) and play the same on a digital audio tape player. Generally, any digital storage medium can be used on which short audio clips can be stored at predetermined locations for selective access. Preferably, a given clip can be accessed in 15 seconds or less, which corresponds to the time it takes to access the corresponding question in the book.

In yet another alternative embodiment, the game is adapted for use by blind persons wherein the question, audio clip, and answer are all provided on the compact disc for audible playing. For example, a given track number may contain an audio tone, a narrated question, another audio tone, the audio clip, another audio tone, a narrated answer, and another audio tone.

DETAILED DESCRIPTION OF SECOND EMBODIMENT

Figure 11:
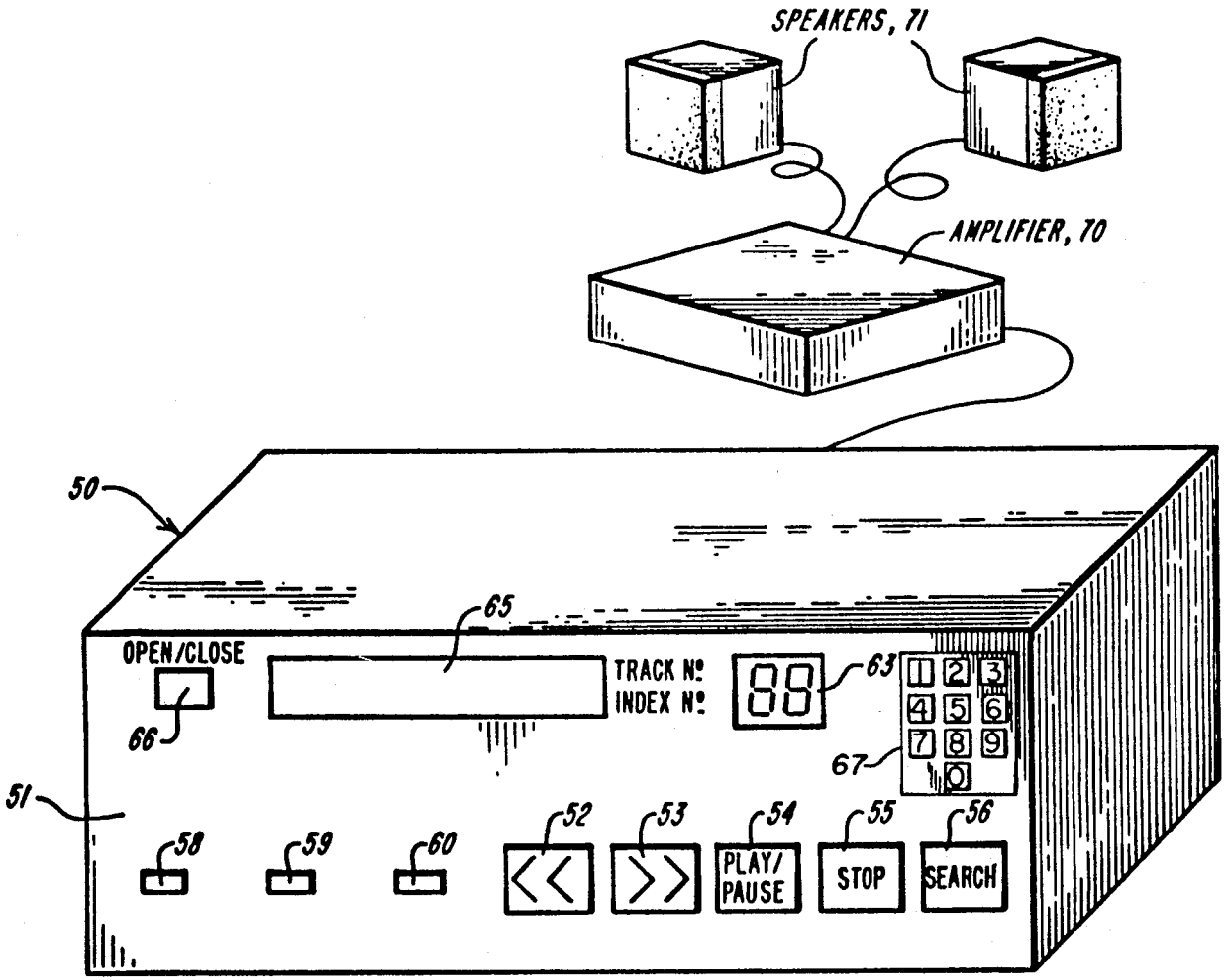
FIG. 11 is a front perspective view of a compact disc player and related amplifier and speakers.
Figure 13:
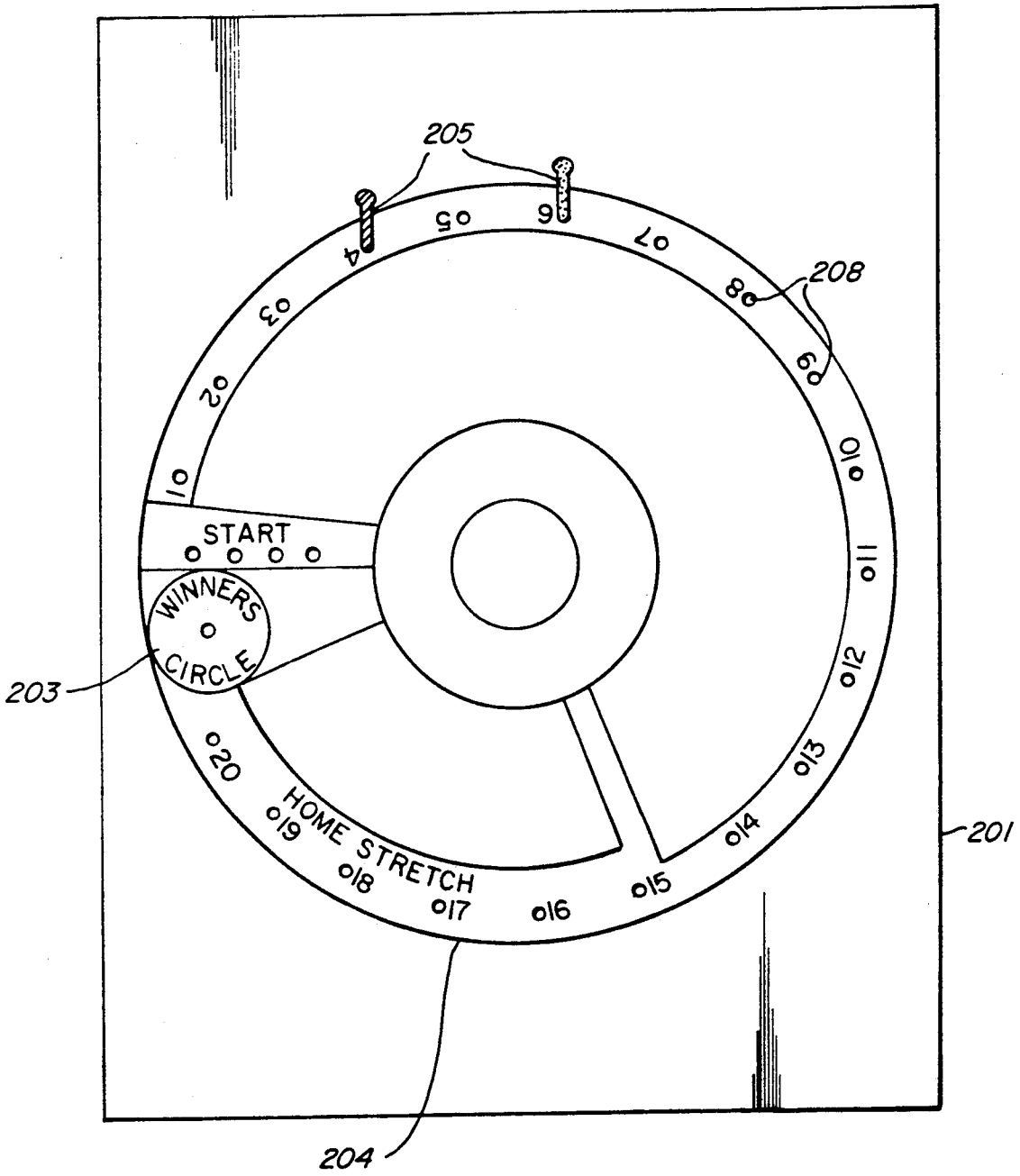
FIG. 13 is a top plan view of a game board and playing pieces to be used in a second embodiment of the game.
Figure 14:
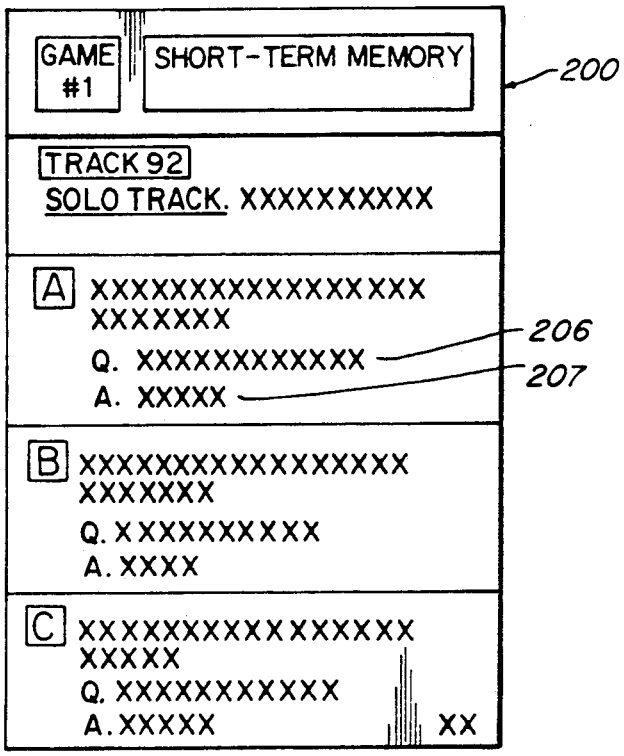
FIG. 14 is a top plan view of a playing card with written questions and answers to be used in a second embodiment of the game.
Figure 15:
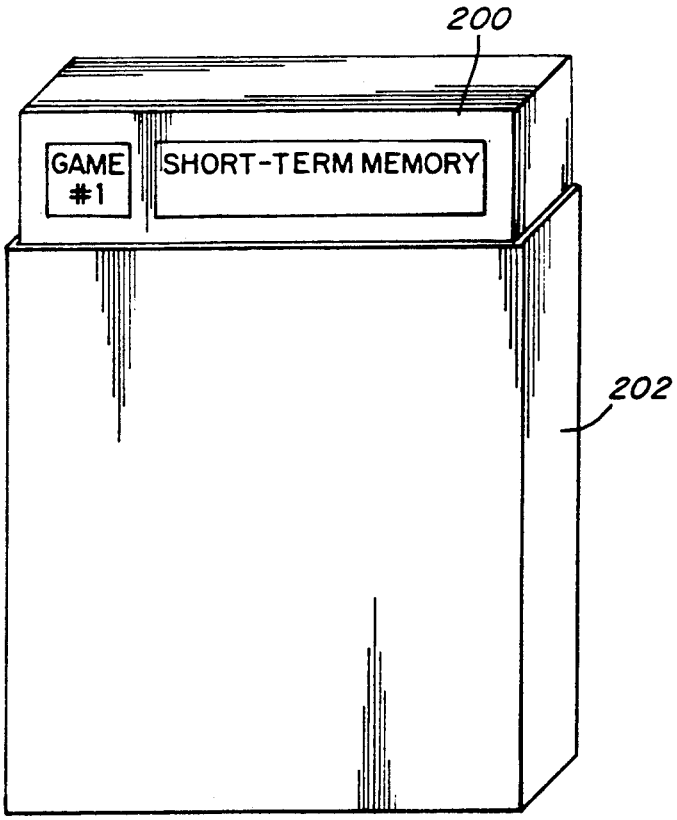
FIG. 15 is a front prospective view of a card holder and deck of cards to be used in a second embodiment of the game.

In a second embodiment, illustrated by FIGS. 13-15, the questions, answers and related track nos. are provided on cards 200 (FIG. 14), instead of a book, and shuffling the deck replaces use of the spinner. The CD 20 of FIGS. 1-2 and CD player 50 of FIG. 11 are used, along with a game board 201 (FIG. 13) and card holder 202 (FIG. 15). A description of the game apparatus will be included with the following description of how the game is played.

The object of the game is to be the first team to reach the "Winner's Circle" 203, or to be the first team to answer three questions in a row correctly while in the "Home Stretch" 204, or to be ahead when the cards run out.

The game pieces include: one CD 20; 300 double-sided cards 200, color-coded for 24 separate matches; card holder 202; and four scoring pegs 205.

The playing time is about 75 minutes to two hours.

To set up the game, two players are selected from any team for special roles—one person is the scorekeeper and another is the CD jockey. The scorekeeper moves the scoring pegs and asks for any challenges or bets before each question is read. Each team selects a peg and places it at "Start."

The CD jockey controls the CD player, and presses "play", "pause" and "track select" buttons as necessary.

The CD jockey loads the CD into the player, presses "play" and, as soon as a tone is heard, presses "pause."

Next, the scorekeeper selects a deck of color-coded cards—titled "game #1" along the top edge of the color band on the cards. There are 24 or 25 cards for this and each successive match. The scorekeeper shuffles them once, and places them inside the card holder 202, as shown in FIG. 15. The flip side of these cards are color-coded differently as the questions/answers on that side are for another game. When the game is over, the cards of this deck (game #1) are returned to the back of the card pack, with the other side of the cards facing to the front. To play another match, a different deck of cards is selected.

Now the game is ready to be played. The players use any method to decide which team will go first. Play will then rotate to their left. Whichever team has its turn is called the active team. One player on the team to their left is called the reader.

Step 1

The reader holds the card holder 202 so he/she can see the front-most card's category, but not any questions. The card behind the front-most card is also raised so that only the category can also be seen by the reader. The reader announces both categories. The active team then says which category they would like. The reader then removes that card from the holder while keeping the unselected card in the holder.

Step 2

The reader announces the track number on the selected card. The CD jockey immediately uses the track button to advance to the correct track and presses pause when the track is reached. The scorekeeper then asks if there are any bets (see description of betting hereinafter).

The reader now reads aloud any instructions at the top of the card, and then the first question. The CD jockey presses play, the first sound clip is heard, and the jockey presses pause at the tone after the clip.

In this embodiment, the following features are provided:

- There are three sound clips provided on each track of the CD (clips A, B and C).
- Sometimes there are three short multiple-choice sounds for each sound clip—the card will tell the players when this applies.
- Generally, questions are read first, then the sound clip is played, and the pause button is pressed at the tone. Sometimes the question is read after the sound clip—if so, the card will tell the players.
- All members of the active team participate in answering questions, unless the card requires one member to answer "solo."
- The other team(s) decide if an answer is correct (compared to the correct answer 207 provided on the card below the question 206), and when the time to answer is up.

Step 3

The active team tries to answer the question. If they answer correctly, they score one point. The scorekeeper moves their peg 205 forward one space. The active team continues to the next question on the card. If they answer incorrectly, their turn is over. The used card is put in a discard pile. The next team—the team to their left—now has a turn. It becomes the active team and steps 1-3 are repeated. A member on the team to the left of the new active team becomes the reader. If a team answers correctly all three questions on a card (A, B and C), it goes again by repeating steps 1 through 3.

Other features of the game include:

- Each sound is heard only once. Everyone must be quiet when a sound clip is played. Questions can be read as many times as necessary.
- After a team reaches the home stretch, it no longer has the privilege of choosing between categories. Instead, the reader's team decides which of the two cards the active team must answer. The scorekeeper must let each team know when it is in the home stretch.

An additional aspect of the game is "jumping." Only one peg 205 can be in a space 208 (designated 1-20) at a time, so if the next space or spaces are occupied by pegs of other teams, the moving peg is advanced to the next vacant space. Thus, several spaces may be skipped on occasion. But, when a team loses a bet (as described below), its peg is moved back to the next vacant space—back over any other pegs.

Another aspect of the game is "betting" or "challenging." Betting is almost as important as answering correctly. A team can bet any number of points they have for their team or against another team, up to two points. A team can only bet points they have. With one-person teams, a limit of one point for each bet may be provided.

A team can bet for itself only if it is their turn—that is, if they are the active team. They bet on getting the next question right. In addition, a team can bet against the opposing active team—betting they'll get the next question wrong. One cannot bet against his own team, or for an opposing team.

The scorekeeper always asks for bets before the reader reads the next question. The reader can not bet, since he/she can see the next question. However, his or her teammates can bet, but they can not communicate in any way with the reader. (If the question comes after the sound clip, as noted on the card, bets must be made before hearing clip).

If a team bets for itself and they win the bet, they get the points bet plus one point for getting the question right.

If a team bets against another team and wins the bet, they get only the points bet.

Either way, if the team loses their bet, they lose the points bet.

When moving pegs the scorekeeper begins with the active team's, then moves the peg of the team on its left, etc.

There are three ways to win:

1) be the first team to get to the "Winner's Circle" 203 or 2) be the first team to enter the "Home Stretch" 204 and answer three questions in a row while in the stretch (sometimes, these three questions will come from two different cards); or 3) be the team ahead in points when the cards run out.

In the second embodiment, the 99 tracks are divided into four "track sets" of 25 or 24 tracks each in serial order (25+25+25+24=99). There are 24 decks of cards, 6 decks associated with each track set; the first deck is associated with tracks 1–25, the second with tracks 26–50, the third with tracks 51–75, the fourth with tracks 76–99, and beginning again with the first track set, the fifth deck with tracks 1–25, etc. This is by way of example only as other track sets or the absence of track sets may also be provided.

Although certain preferred embodiments of this invention have hereinbefore been described, it will be appreciated that variations of this invention will be perceived by those skilled in the art, which variations are nevertheless within the scope of this invention as defined by the claims appended hereto.

What is claimed is:

1. A method of playing a game wherein a player provides an answer to a selected question after listening to a related audio clip, the method comprising the steps of:

providing a source of questions and answers, each question and answer being selectively accessable and provided with a related track-identifying means, and a separate digital storage device having tracks, each track having a track-identifying means and containing information which relates to a specific question;

selecting and reviewing a question;

accessing a specified track on the digital storage device having the track-identifying means corresponding to that of the selected question;

reviewing an audio clip on the specified track;

attempting to answer the selected question in view of the information provided in the audio clip; and comparing the answer to a correct answer provided in the source of questions and answers.

2. The method of claim 1 further comprising, providing serially arranged questions relating to a given track and serially accessing the related audio clips on the specified track.

3. The method of claim 1 further comprising, providing audio cues between each clip on the track and pausing when a cue is heard in order to select the next question.

4. The method of claim 1 further comprising, providing a game board and playing pieces wherein a playing piece is advanced on the board when a question is correctly answered.

5. The method of claim 1 further comprising betting on whether a question will be correctly answered before the attempted answer is given.

6. Apparatus for playing an audio quiz game wherein a player provides an answer to a question after listening to an audio clip, the apparatus comprising:

a set of randomly accessible questions and answers, each question having a different track-identifying means;

a digital storage device having a plurality of tracks for storing digital information, each track being identified by one of the track-identifying means and containing at least one audio clip; and means for locating within the digital storage device the audio clip corresponding to the track-identifying means;

wherein the game is played by selecting a question, locating the audio clip having the corresponding track-identifying means of the selected question, answering the question as it relates to the audio clip, and comparing the player's answer to the correct answer contained in the set of questions and answers.

7. The apparatus of claim 6, wherein a plurality of clips are provided on a track so that one or more clips can be serially accessed by accessing a given track.

8. The apparatus of claim 7, wherein the plurality of clips on a given track relate to the same subject matter.

9. The apparatus of claim 6, wherein the digital storage device is an optical disc.

10. Apparatus for playing an audio quiz game wherein a player provides an answer to a question after listening to an audio clip, the apparatus comprising:

means for randomly obtaining a specific track identifier from a set of track identifiers;

a source of questions wherein there is at least one question corresponding to every track identifier in the set;

means for locating within the source of questions the question corresponding to the specific track identifier;

a digital storage device having a plurality of tracks for storing digital information, each track being identified by a different track identifier in the set and containing at least one audio clip;

means for locating within the digital storage device the audio clip corresponding to the specific track identifier;

a source of answers, each answer corresponding to a specific question and audio clip;

means for locating within the source of answers the answer corresponding to the related question;

wherein the game is played by randomly obtaining a specific track identifier, locating the question and audio clip corresponding to the specific track identifier, answering the question as it relates to the audio clip, and comparing the player's answer to the correct answer contained in the source of answers.

11. The apparatus of claim 10, wherein each track contains a plurality of different audio clips and all of the clips on one track relate to the same subject matter.

12. The apparatus of claim 10, wherein the digital storage device is an optical disc.

13. The apparatus of claim 10, further comprising means for recording which questions have already been played.

14. The apparatus of claim 10, further comprising a means for recording a player's score as he correctly answers a question.

15. The apparatus of claim 10, wherein the set of questions and answers is written.

16. Apparatus for playing an audio quiz game wherein a player provides the answer to a preselected question after listening to a preselected audio clip, the apparatus comprising:

means for generating a number from a set of numbers;

a digital storage device having a plurality of tracks for storing digital information which tracks contain different audio clips separated by audio cues and the audio clips are disposed at predetermined locations which correspond to the numbers of the set, wherein each audio clip may be selectively accessed and played in conjunction with a preselected question; and a source containing a plurality of written questions and answers wherein at least one question and answer relates to each said audio clip, means for identifying the number of the audio clip to which a given question and answer relates, and means for selectively accessing the answer to one question at a time.

17. The apparatus of claim 16, wherein the digital storage device is an optical disc.

18. The apparatus of claim 16, wherein the clips are disposed on predetermined tracks so that one or more clips can be accessed by accessing a given track.

19. The apparatus of claim 16, wherein each track contains a plurality of different audio clips and all of the clips on one track relate to the same subject matter.

20. The apparatus of claim 16, wherein the source is a book comprising a plurality of sheets forming pages of the book, a plurality of dividers disposed between the pages, binding means for holding together the pages and dividers of the book, tab means extending from the dividers with identifying labels to facilitate selection of an adjacent page, each page comprising a plurality of segments wherein each segment can be turned separately from the other segments on the page, each segment containing a question on its front surface and an answer on its back surface, wherein all of the questions and answers on the segments of one page relate to one clip, the tab means on the divider adjacent the one page identifying the number of the corresponding one clip, and each divider permitting the segments of the adjacent page to be turned over as a group while masking the adjacent surfaces of the segments.

21. The apparatus of claim 16, further comprising a game board having a track with a plurality of spaces between a starting point and a finishing point wherein a player advances a token along the track when he correctly answers a question.

* * * * *